US006962094B2

(12) United States Patent
Porter et al.

(10) Patent No.: US 6,962,094 B2
(45) Date of Patent: Nov. 8, 2005

(54) ADJUSTABLE PEDAL ASSEMBLY

(75) Inventors: Curtis H. Porter, Huntsville, MO (US); Theodore Richardson, Orrville, OH (US); Larry B Champ, Cairo, MO (US)

(73) Assignee: Orscheln Products LLC, Moberly, MO (US)

( * ) Notice: Subject to any disclaimer, the term of this patent is extended or adjusted under 35 U.S.C. 154(b) by 0 days.

(21) Appl. No.: 10/057,400

(22) Filed: Jan. 24, 2002

(65) Prior Publication Data

US 2002/0157497 A1 Oct. 31, 2002

Related U.S. Application Data

(60) Provisional application No. 60/263,926, filed on Jan. 24, 2001.

(51) Int. Cl.[7] ..... G05G 1/14
(52) U.S. Cl. ..... 74/512
(58) Field of Search ..... 74/512, 513, 560, 74/562, 564

(56) References Cited

U.S. PATENT DOCUMENTS

| | | | |
|---|---|---|---|
| 1,994,699 | A | 3/1935 | Gehbauer |
| 2,032,157 | A | 3/1936 | Dresser et al. |
| 2,491,898 | A | 12/1949 | Luketa |
| 2,873,616 | A | 2/1959 | Schilling |
| 2,944,439 | A | 7/1960 | Dalton |
| 3,059,960 | A | 10/1962 | Komorowski et al. |
| 3,602,181 | A | 8/1971 | Harris |
| 3,630,326 | A | 12/1971 | Kawaguchi |
| 4,180,812 | A | 12/1979 | Kaltenbach et al. |
| 4,271,718 | A | 6/1981 | Bopp et al. |
| 4,470,570 | A | 9/1984 | Sakurai et al. |
| 4,499,963 | A | 2/1985 | Liston |
| 4,683,977 | A | 8/1987 | Salmon |
| 4,702,713 | A | 10/1987 | Lee |
| 4,805,481 | A | 2/1989 | Bauer et al. |
| 4,848,708 | A | 7/1989 | Farrell et al. |
| 4,870,871 | A | 10/1989 | Ivan |
| 4,875,385 | A | 10/1989 | Sitrin |
| 4,915,075 | A | 4/1990 | Brown |
| 4,958,607 | A | 9/1990 | Lundberg |
| 4,989,474 | A | 2/1991 | Cicotte et al. |
| 5,010,782 | A | 4/1991 | Asano et al. |
| 5,027,673 | A | 7/1991 | Behrens et al. |
| 5,078,024 | A | 1/1992 | Cicotte et al. |
| 5,086,663 | A | 2/1992 | Asano et al. |
| 5,106,121 | A | 4/1992 | Boone |
| 5,152,703 | A | 10/1992 | Clement |
| 5,309,361 | A | 5/1994 | Drott et al. |
| 5,438,516 | A | 8/1995 | Neubauer et al. |
| 5,448,928 | A | 9/1995 | Harger |
| 5,460,061 | A | 10/1995 | Redding et al. |
| 5,465,633 | A | 11/1995 | Bernloehr |
| 5,477,746 | A | 12/1995 | Perisho et al. |
| 5,583,407 | A | 12/1996 | Yamaguchi |
| 5,632,183 | A | 5/1997 | Rixon et al. |

(Continued)

FOREIGN PATENT DOCUMENTS

| | | |
|---|---|---|
| EP | 0256466 | 2/1988 |

(Continued)

*Primary Examiner*—Xuan Lan Nguyen
(74) *Attorney, Agent, or Firm*—Michael K. Boyer

(57) ABSTRACT

An adjustable pedal assembly is disclosed that comprises a stationary mounting plate, a sliding mounting plate that receives a brake pedal and a throttle pedal, and a drive mechanism for displacing the sliding mounting plate relative to the stationary mounting plate.

18 Claims, 7 Drawing Sheets

U.S. PATENT DOCUMENTS

| | | | |
|---|---|---|---|
| 5,697,260 | A | 12/1997 | Rixon et al. |
| 5,722,302 | A | 3/1998 | Rixon et al. |
| 5,755,138 | A | 5/1998 | Mototani et al. |
| 5,771,752 | A | 6/1998 | Cicotte |
| 5,787,783 | A | 8/1998 | Evans et al. |
| 5,819,593 | A | 10/1998 | Rixon et al. |
| 5,823,064 | A | 10/1998 | Cicotte |
| 5,826,463 | A | 10/1998 | Monson |
| 5,845,539 | A | 12/1998 | Huang |
| 5,884,532 | A | 3/1999 | Rixon et al. |
| 5,885,143 | A | 3/1999 | Ichikawa et al. |
| 5,890,399 | A | 4/1999 | Rixon et al. |
| 6,182,525 | B1 | 2/2001 | Bowers et al. |
| 6,191,374 | B1 | 2/2001 | Schulze |
| 6,220,112 | B1 | 4/2001 | Graham et al. |
| 6,223,623 | B1 | 5/2001 | Vance |
| 6,237,565 | B1 | 5/2001 | Engelgau |
| 6,298,748 | B1 | 10/2001 | Rixon et al. |
| 6,324,939 | B1 | 12/2001 | Cicotte |
| 6,364,047 | B1 | 4/2002 | Bortolon |
| 2002/0007979 | A1 | 1/2002 | Wilson |
| 2002/0148668 | A1 | 10/2002 | Smythe |

FOREIGN PATENT DOCUMENTS

| | | |
|---|---|---|
| EP | WO9013862 | 11/1990 |
| EP | 0 530 128 A1 | 8/1992 |
| EP | WO0176924 | 10/2001 |
| JP | 62050532 | 3/1987 |
| WO | WO 02/061521 A2 | 8/2002 |

ADJUSTABLE PEDAL ASSEMBLY

The subject matter herein claims benefit under 35 U.S.C. 119(e) of U.S. Patent Application Ser. No. 60/263,926, filed Jan. 24, 2001 and entitled "Adjustable Pedal Assembly"; the disclosure of which is hereby incorporated by reference.

FIELD OF THE INVENTION

The instant invention relates to an adjustable pedal system for use such as in golf cars, automobiles, recreational vehicles, all terrain vehicles, lawn equipment and tractors, utility cars, industrial vehicles such as tractors, buses, among other on/off road vehicles.

BACKGROUND OF THE INVENTION

Conventional pedal assemblies are used as an interface between an operator and a vehicle so that the vehicle can be operated by pedal controls. These controls are typically in the form of a pedal assembly comprising a service brake, parking brake and in some cases an accelerator (or throttle control). Power can be supplied to the vehicle by an electric motor or internal combustion engine. Conventional pedal assemblies contain a large number of components, and are time consuming to assemble. Conventional pedal assemblies can be relatively complex and include multiple pivot points, linkages, springs, pawls, ratchets, among other components.

Adjustable pedal assemblies are known in this art. Examples of conventional adjustable pedal assemblies are disclosed in U.S. Pat. Nos. 3,643,525; 4,875,385; 5,078,024; 5,233,882; 5,460,061; 5,964,125; and 5,697,260; the disclosure of each of which is hereby incorporated by reference. It is also known in this art to employ an electronic engine control by operation of an electronic throttle pedal. Examples electronic throttle controls are described in U.S. Pat. Nos. 4,944,269; 4,958,607; 4,976,166; 5,408,899; and 5,241,936; the disclosure of each of which is hereby incorporated by reference.

There is a need in this art for an adjustable pedal assembly having a relatively low number of parts, ease of fabrication, travel limit controls, that is floor mountable and can be installed by original equipment manufacturers or retrofit onto existing vehicles.

CROSS REFERENCE TO RELATED PATENTS AND PATENT APPLICATIONS

The subject matter disclosed herein is related to copending and commonly assigned U.S. Non-provisional patent application Ser. No. 09/715,645, filed on Nov. 17, 2000 in the name of Curtis H. Porter et al. and entitled "Pedal Assembly"; the disclosure of which is hereby incorporated by reference.

SUMMARY OF THE INVENTION

The instant invention solves problems associated with conventional adjustable pedal assemblies by providing an assembly comprising a stationary mounting plate, a sliding mounting plate (e.g., sliding plate or sliding mounting plate are used interchangeable herein in that the sliding plate receives at least one pedal), that receives a brake pedal and a throttle pedal, and a drive mechanism for displacing the sliding mounting plate relative to the stationary mounting plate. The inventive assembly can also reduce the number of components and related connections (including adjusting mechanisms) employed in comparison to conventional pedal assemblies. The assembly can further comprise a movement control system that stops displacement of the sliding mounting plate without electrically overloading the system.

DETAILED DESCRIPTION

Figure 1:
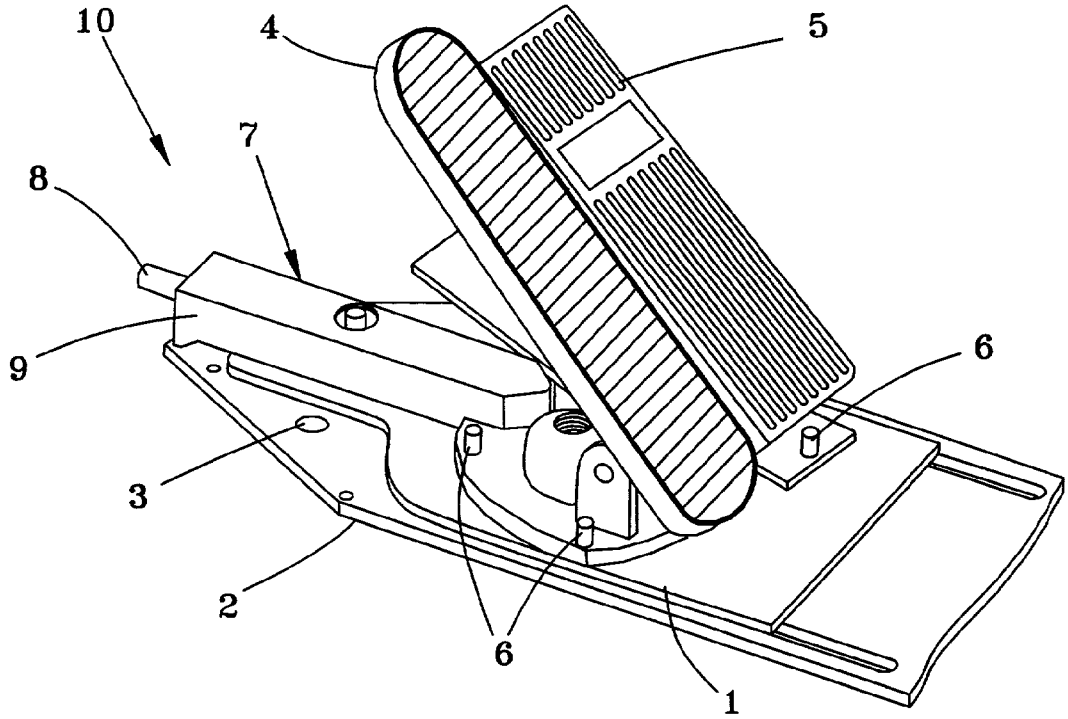
FIG. 1 illustrates one aspect of the invention from a side oblique view.

The instant invention relates to an assembly comprising a stationary mounting plate, a sliding mounting plate that receives at least one of a brake pedal and a throttle pedal (and if desired a clutch pedal, hydraulic or pneumatic control pedals, among others), and an adjacent drive mechanism for displacing the sliding mounting plate relative to the stationary mounting plate. By adjacent it is meant term "adjacent" as used in this specification and the claims, unless expressly stated otherwise, means two components that are in contact with each other, are next to each other with a space separating them, or are next to each other with a third component in between. The drive mechanism can further comprise a movement control system that stops displacement of the sliding mounting plate without electrically overloading the system.

The inventive assembly can be employed by original equipment vehicle manufacturers, or installed to retrofit existing vehicles. In connection with original equipment manufacturers, the inventive assembly provides increased flexibility in the manufacturing processes; especially for manufacturers that attach body components at a location remote from chassis production. Typically, the inventive assembly is mounted onto the floor of the vehicle. That is, the stationary mounting plate is affixed or adjacent to the floor of the vehicle.

The movement of the sliding mounting plate, which carries the pedals, upon the stationary mounting plate is generally linear. If desired, however, the stationary mounting plate or sliding plate can be configured so as to cause the pedals to raise, lower or move in an arcuate motion. Movement of the drive mechanism causes the sliding mounting plate to be displaced, relative to the stationary mounting plate, which in turn causes the pedals to move closer or further from the vehicle operator.

While any suitable interface between the sliding mounting plate and the stationary mounting plate can be employed, normally the interface will be at three locations. The interface can be achieved by any suitable means such as pins, rivets, bolts, among others, on the sliding mounting plate that move along slots, channels, grooves, among others, defined on the stationary mounting plate. The three point interface between the plates permits linear movement of the sliding mounting plate, and minimizes any binding, flexing, or torsional forces to develop in the assembly.

Any suitable drive mechanism can be employed for displacing the sliding plate relative to the stationary plate. The drive mechanism can comprise a rotating cable or conduit, direct drive couple or universal joint that provides a force for moving the sliding plate, rack and pinion, worm gear, magnetic drive, springs, crank or knob, among other suitable electrical and mechanical drive mechanisms.

In one aspect of the invention, the drive mechanism comprises a mounting plate (or drive screw mounting/support bracket), drive screw, trunion, drive screw plate and cover. The drive screw is rotationally supported by the mounting block (on the stationary mounting plate) and the drive screw plate (on the sliding mounting plate). The trunion is mounted about the drive screw, and removably connected to the mechanism cover. A washer or other type of fastener guides the trunion to the mechanism cover, e.g., a protuberance on the trunion extends through an opening defined in the mechanism cover. The drive mechanism cover protects the mechanism from debris and prevents unintended contact between the drive mechanism and the vehicle operator (e.g., operator clothing, shoe laces, among other items). The drive screw plate is affixed to the sliding mounting plate. Rotation of the drive screw causes generally linear movement of the drive screw plate (e.g., forward/backward), and sliding mounting plate and in turn the pedals. This configuration of the drive mechanism permits for limited flexibility of the drive screw about its longitudinal axis, and trunion about the drive screw and within the mechanism cover opening. The previously described three point interface and flexible drive mechanism provides defined linear movement and compensates for any misalignment in the assembly.

The displacement or movement of the sliding mounting plate is defined by a movement control system. The movement control systems comprises limit switches, vehicle operator switch, electrical contacts among a battery, drive motor and all switches (e.g., refer to FIGS. 9 and 10). Depending upon the capacity of the electrical contacts, switches and relays, a 5 to 10 Amp fuse can be included in the system. The movement control system comprises at least two limit switches that define the maximum forward and rearward movement of the sliding mounting plate. While the sliding mounting plate is positioned between the limit switches, the vehicle operator can determine the exact location of the pedals by using the vehicle operator switch (e.g., toggle switch).

The components of the instant invention can be fabricated from any suitable materials. Examples of suitable materials comprise stamped metals, injection molded components such as mineral reinforced nylon, among other conventionally used materials.

The service brake component of the invention can employ commercially available systems such as those described in the aforementioned patents. The force from the brake pedal is connected via conventional means to the braking system. While any suitable means can be employed, one suitable means comprises flexible hydraulic hoses (e.g., fabricated from an elastomeric material). The flexible hoses accommodate movement of the sliding plate while maintaining operational connection with the braking system (e.g., master cylinder). If desired, the service brake can be combined with a parking brake such as described in the aforementioned copending and commonly assigned non-provisional patent application Ser. No. 09/715,645.

The throttle component of the invention can also employ commercially available systems such as those described in the aforementioned patents. Normally, the throttle component will comprise an electronic foot pedal wherein movement of the foot pedal causes an electrical signal to vary engine operation (e.g., "throttle by wire").

Certain aspects of the instant invention are better understood by reference to the drawings. Referring now to the drawings, FIG. 1 illustrates one aspect of the inventive assembly 10 wherein sliding mounting plate 1 is located upon stationary mounting plate 2. Stationary mounting plate 2 includes a plurality of fasteners 3 for affixing assembly 10 to the floor of a vehicle. Service brake pedal 4 and throttle pedal 5 are affixed to sliding mounting plate 1 by using fasteners 6. Service brake pedal 4 and throttle pedal 5 are linearly displaced (along with sliding mounting plate 1) relative to stationary mounting plate 2 by operation of drive mechanism 7. Drive mechanism 7 comprises drive screw 8, mechanism cover 9, among other components not shown in FIG. 1.

Figure 2:
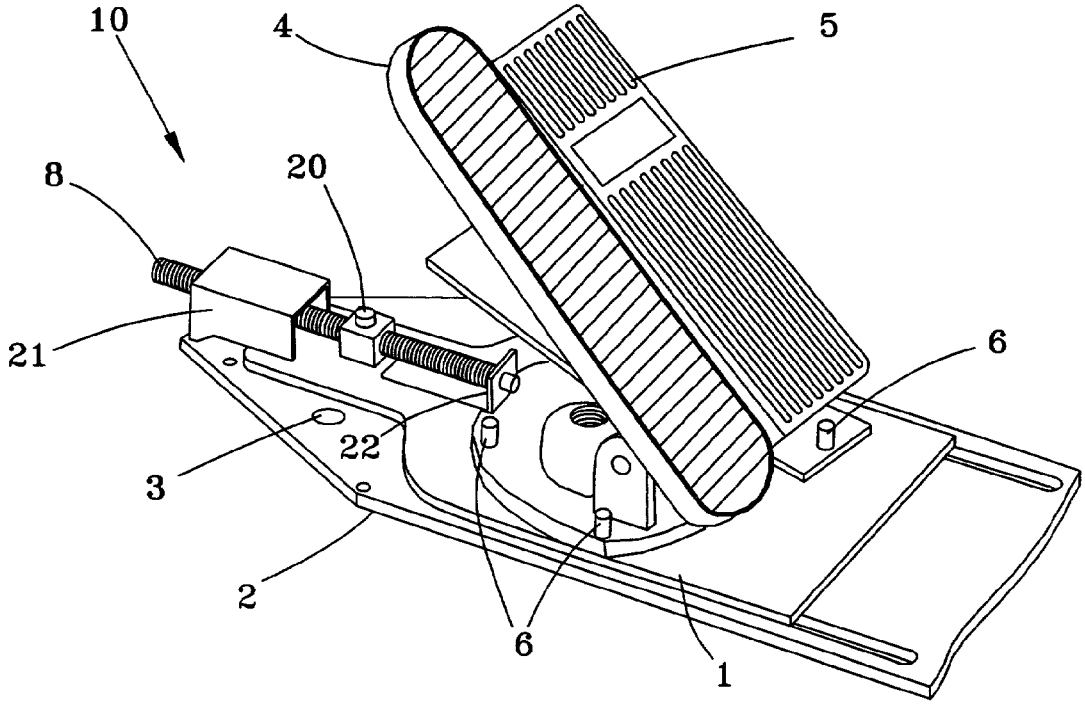
FIG. 2 illustrates the aspect of FIG. 1 that shows a drive mechanism.
Figure 3:
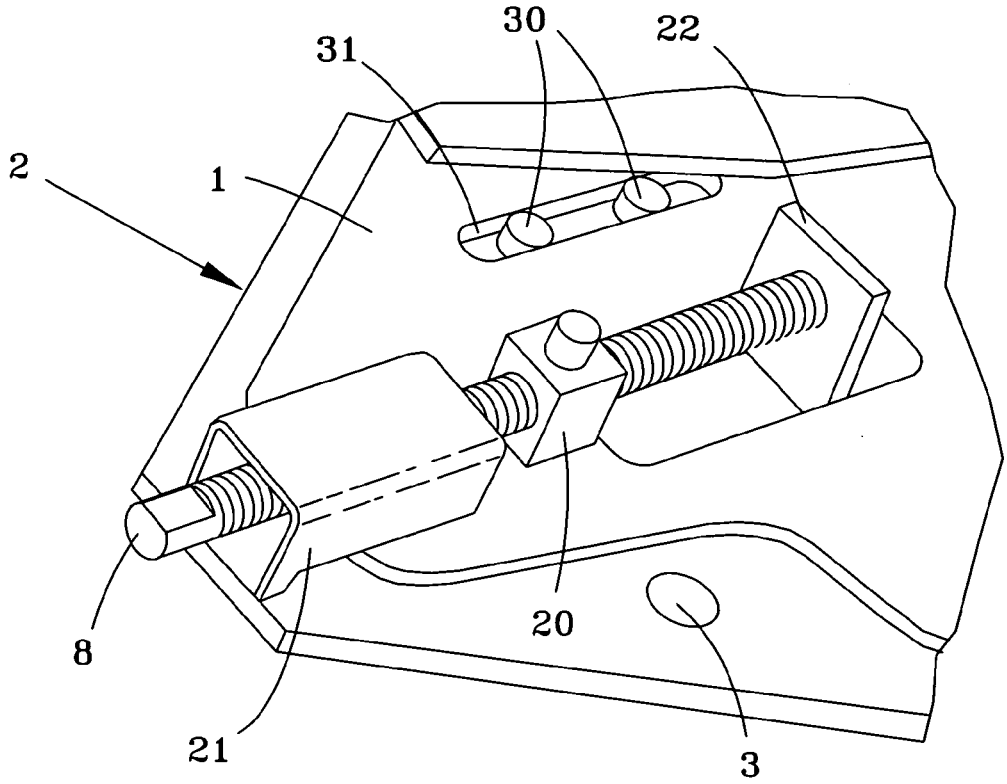
FIG. 3 illustrates the drive mechanism of FIG. 2.

Referring now to FIGS. 2 and 3, FIGS. 2 and 3 illustrate drive mechanism 7 (without mechanism cover 9). Drive mechanism 7 comprises drive screw 8, trunion 20, stationary or static cover 21 and drive screw mounting plate 22. Mechanism cover 9 is attached to and travels with sliding plate 1, and located above or around static cover 21 such that mechanism cover 9 protects static cover 21. Drive screw mounting plate 22 is affixed to sliding mounting plate 1. Trunion 20 includes a protuberance that extends upwardly and engages an opening defined in mechanism cover 9. Rotation of drive screw 8 causes the drive screw mounting plate 22 to be displaced generally linearly which also causes sliding mounting plate 1 to be displaced.

Figure 5:
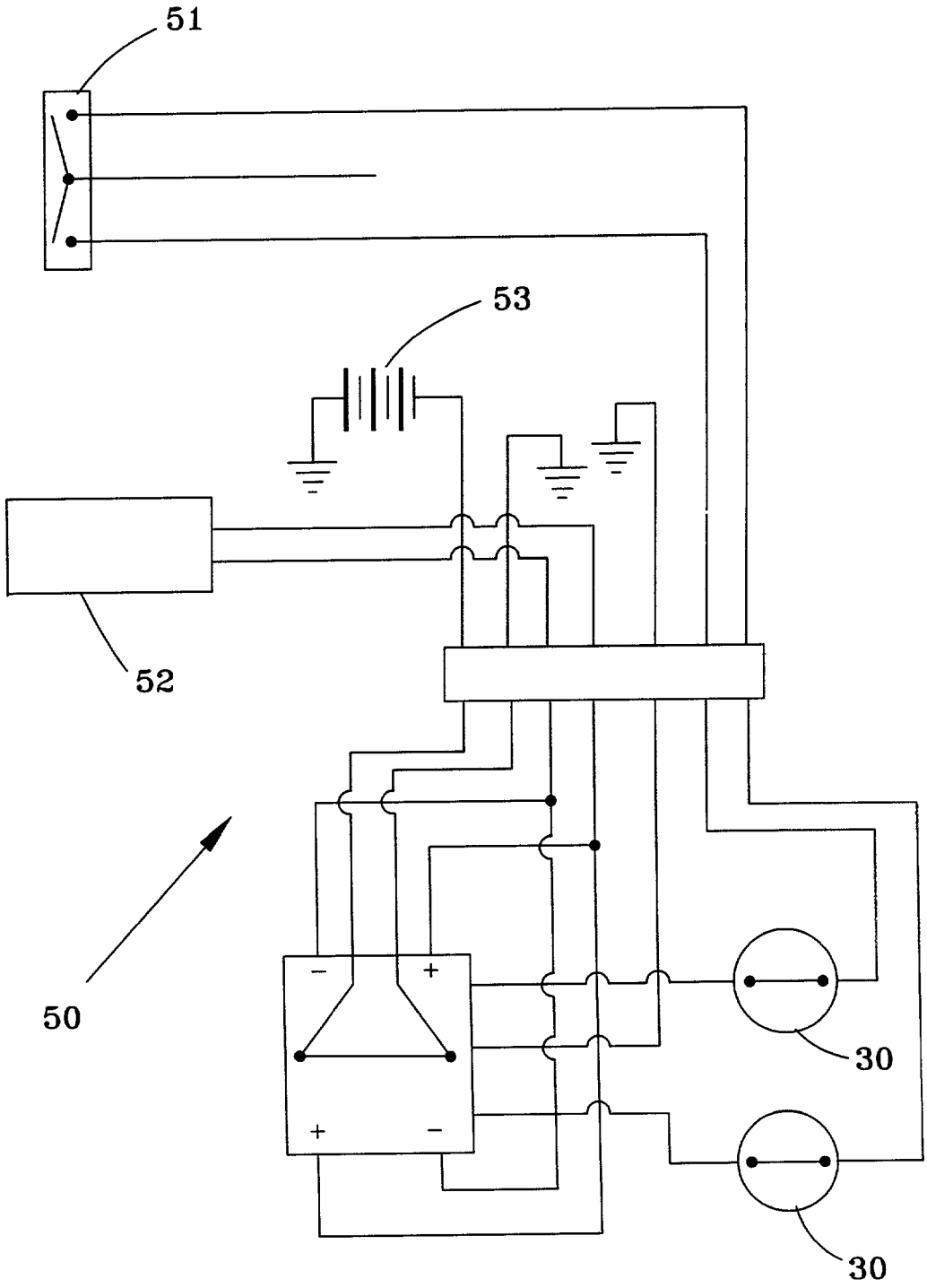
FIG. 5 illustrates a schematic drawing of an electronic control system that can be used to operate the inventive assembly of FIG. 1.

FIG. 3 further illustrates limit switches 30 that are employed in the movement control system (ref to FIG. 5). Limit switches 30 are mounted in stationary mounting plate 2 and extend into slot 31 defined in sliding mounting plate 1. Limit switches 30 are electrically connected to the movement control system and prevent operation of the movement control system beyond predefined positions. As the sliding mounting plate 1 moves along stationary mounting plate 2, limit switches 30 are activated when the sliding mounting plate 1 reaches one end of its defined linear path. Activation of a first limit switch at one end of its defined path (i.e., the distance defined by slot 31), prevents continued movement beyond that end point of the defined path. The assembly can then only be operated in a reverse direction until the first switch has been deactivated, or until the second limit switch (at the second end of the assembly's defined path or slot 31) has been activated. That is, the sliding plate may take any position between limit switches 30.

Figure 4:
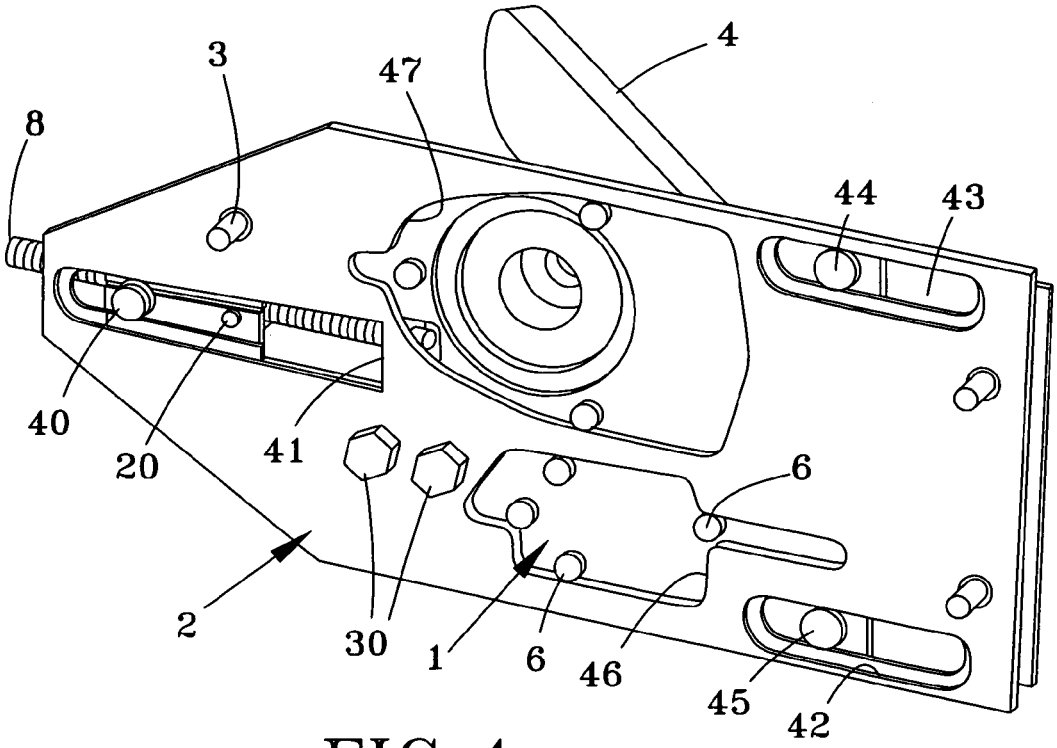
FIG. 4 illustrates the aspect of FIG. 1 from a reverse view.

Referring now to FIG. 4, FIG. 4 illustrates the inventive assembly of FIGS. 1–3 from a reverse angle. FIG. 4 shows slots 41, 42 and 43 defined within stationary plate 2. Pins 40, 44 and 45 are associated with sliding mounting plate 1, and engage, respectively, slots 41, 42 and 43. As drive mechanism 7 displaces sliding plate 1, the linear direction of sliding plate 1 is guided by the pins within the slots. Slots 46 and 47 permit movement of sliding mounting plate 1 without damaging fasteners 6. Slots 46 and 47 also permit mechanical and electrical connections to pedals 4 and 5.

Referring now to FIG. 5, FIG. 5 illustrates an electrical schematic of a movement control system 50. System 50 provides electrical connection among limit switches 30, vehicle operator control switch 51, electrical motor 52, and battery 53. Battery 53 comprises the primary vehicle battery (e.g., 12 volt) that can be supplemented by one or more auxiliary batteries. The vehicle operator can adjust the position of the pedals by activating vehicle operator control switch 51. A signal from the switch corresponds to a forward or backward movement of the sliding mounting plate 1/pedals 4 and 5. The signal from switch 51 causes electrical current to reach motor 52 that causes drive screw 8 to move sliding mounting plate 1. Continued activation of switch 51 causes movement of sliding mounting plate 1 until one of the limit switches 30 are activated.

Figure 6:
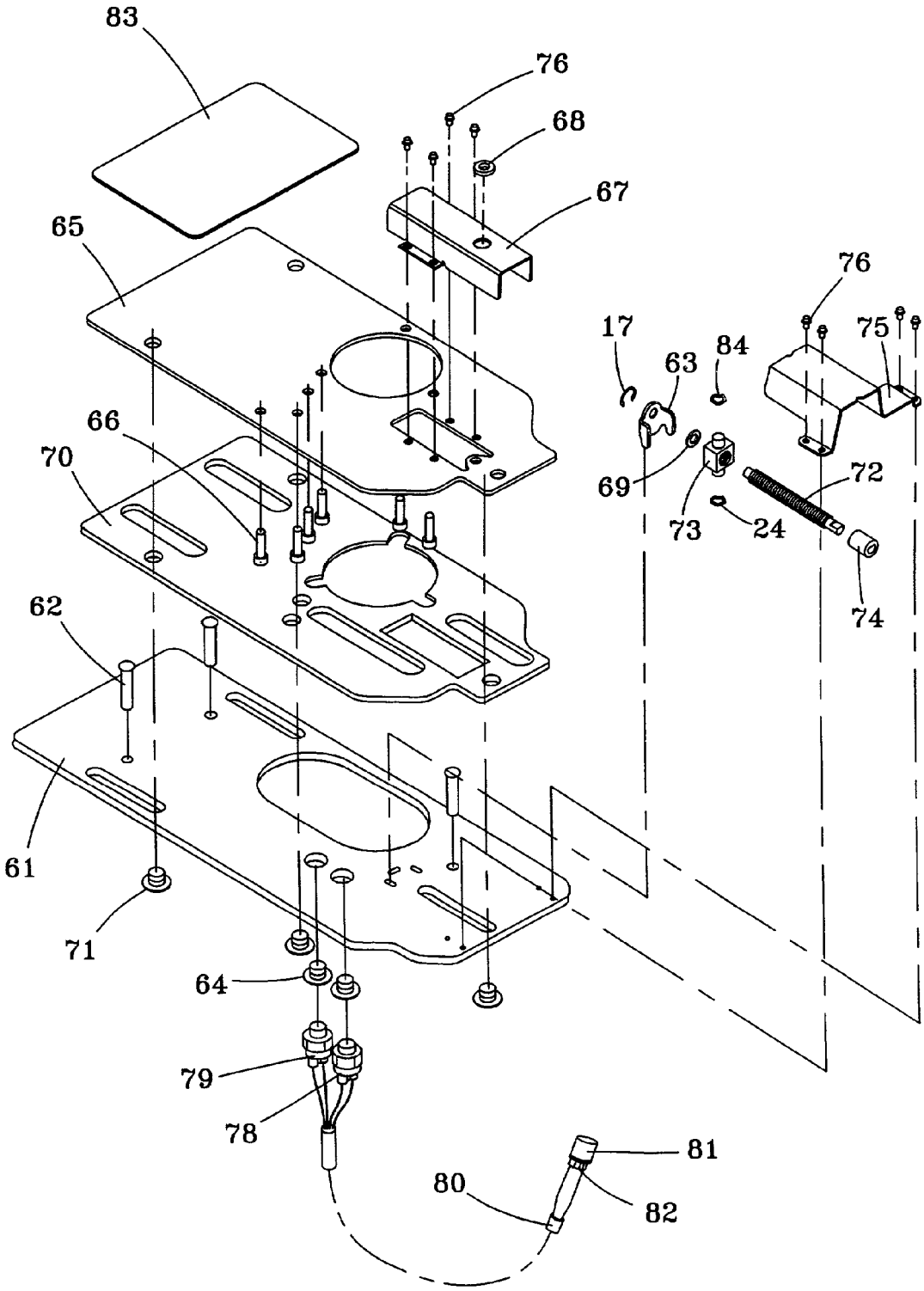
FIG. 6 illustrates another aspect of the invention in an exploded format.

Referring now to FIG. 6, FIG. 6 illustrates another aspect of the inventive pedal assembly 60. Pedal assembly 60 comprises a mounting or stationary plate 61 and studs (or other suitable fasteners) 62. Fasteners 62 locate the pedal assembly 60 onto the floor of a vehicle. A drive screw mounting bracket 63 is located upon stationary plate 61 and extends through an opening defined upon sliding plate 65 that is located above stationary plate 61. Stationary plate 61 also defines openings for receiving electrical fasteners 64 that connect limit switches (described below in greater detail). Sliding plate 65 defines openings for receiving fasteners 66 that are employed for attaching pedals (e.g., service brake and throttle-not shown) to the sliding plate 65. Sliding plate 65 is protected from vehicle operator wear by pad 83. Stationary plate 61 and sliding plate 65 define openings that at least partially overlap that permit interconnection (not shown) between the foot pedals and the braking and throttle systems.

A spacer 70 is located between stationary plate 61 and sliding plate 65. Spacer 70 functions to provide a low friction surface for sliding plate 65 as it moves along stationary plate 61. Spacer 70 can be fabricated from any suitable material such as high density polyethylene. Spacer 70 defines openings for receiving slide rivets (described below in greater detail), limit switches, fasteners, drive screw mounting bracket, and interconnection to the braking and throttle systems.

Sliding plate 65 and spacer 70 are maintained in a defined range of positions relative to the stationary plate 61 by slide rivets 71. Slide rivets 71 are dimensioned to be received within slots defined in sliding plate 65, spacer 70 and stationary plate 61. Slide rivets 71 are affixed to sliding plate 65 and have an enlarged head that prevent the rivets from disengaging stationary plate 61.

The drive mechanism is protected by a moving shield 67 having a spacer or washer 68 and fasteners 76 for attaching the moving shield 67 onto sliding plate 65. Drive screw mounting bracket 63 is covered by moving shield 67. Mounting bracket 63 supports drive nut 73 and is separated from the drive nut 73 by shim 69. External threaded drive screw 72 engages internal threads of drive nut 73. Drive screw 72 extends through drive nut 73 and is maintained in a fixed rotating position relative to drive nut 73 by clip 77. Drive nut 73 protrudes through an opening defined in moving shield 67 and is connected to the moving shield 67 by washer 68 and wave washer 84.

The drive screw 72 defines a journaled surface for receiving coupler 74 (described in greater detail in connection with FIG. 7). Coupler 74 engages an electric motor (described in greater detail in connection with FIG. 9). Drive screw 72 is protected by stationary or static shield 75. Static shield 75 is attached to stationary plate 61 by fasteners 76 (e.g., self-tapping screws). Static shield 75 is dimensioned to either be received within moving shield 67 or large enough to receive moving shield 67. Displacement of the moving shield 67, sliding plate 65, and spacer 70 is achieved by rotation of drive screw 72. Rotation of drive screw 72 (e.g., by an electric motor) causes the threaded portion of screw 72 to engage the threads of drive nut 73 and in turn apply a force upon sliding plate 65 that is sufficient to displace plate 65 relative to stationary plate 61.

The movement of sliding plate 65 by operation of the drive mechanism (e.g., rotation of drive screw 72) is controlled electronically. Travel limit switches 78 and 79 extend through openings defined in stationary plate 61 and spacer 70 and engage recesses defined in sliding plate 65 (described in greater detail in connection with FIG. 8). Travel limit switches 78 and 79 are electrically interconnected via wiring harness 80 having wires (e.g., four) 82 and electrical connector 81. Wiring harness 80 provides an electrical connection among an electrical motor (described in greater detail in connection with FIGS. 9A through 9C), limit switches 78 and 79 and electrical control system (described in greater detail in connection with FIG. 10).

Figure 7:
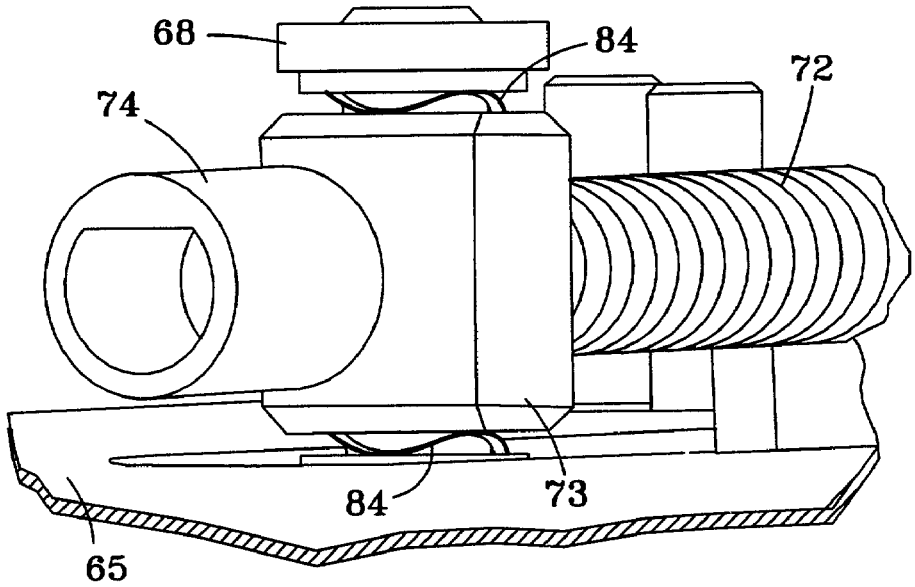
FIG. 7 illustrates the end of the drive mechanism of FIG. 6.

Referring now to FIG. 7, FIG. 7 illustrates coupler 74 affixed to drive screw 72. Coupler 74 is compression fit or otherwise attached onto drive screw 72. Coupler 74 defines a flat or keyed region which is dimensioned to receive an electric motor shaft. Coupler 74 ensures that the force applied by the electric motor is effectively transferred to drive screw 72.

Figure 8:
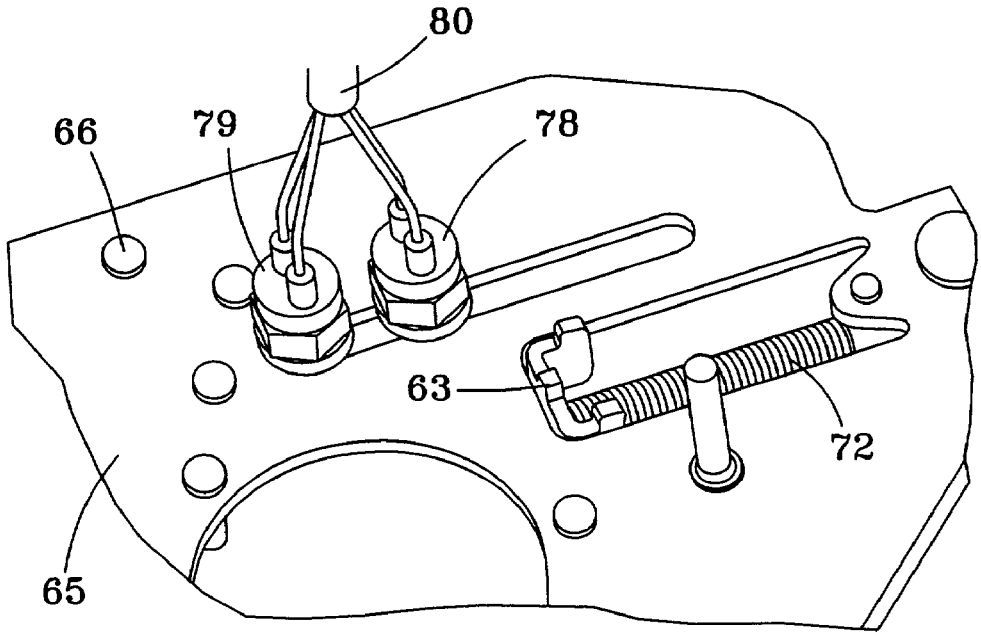
FIG. 8 illustrates the interconnection between an electronic control system and the aspect of the invention illustrated in FIG. 6.

Referring now to FIG. 8, FIG. 8 illustrates limit switches 78 and 79 extending into a recess defined in the lower side or underneath of sliding plate 65. Limit switches 78 and 79 are in a fixed location upon stationary plate 61 and travel within the recess as sliding plate 65 is adjusted. The sliding plate 65 is free to travel among all positions between the limit switches. When the sliding plate 65 travels to a location wherein one of the limit switches contacts a distal or end point of the recess then the limit switch is activated thereby disengaging an electrical motor (which rotates the drive screw that displaces the sliding plate-refer also to FIGS. 9A through 9C), and preventing further movement of the sliding plate in that direction. When a limit switch is activated, the sliding plate is only permitted to move in a direction opposite to that prior to switch activation.

Figure 9B:
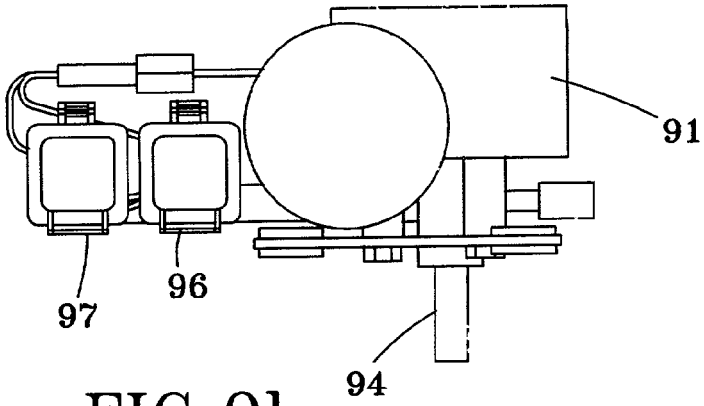
FIGS. 9A through 9C illustrate an electronic drive system that can be used to operate the inventive assembly of FIG. 6.
Figure 9A:
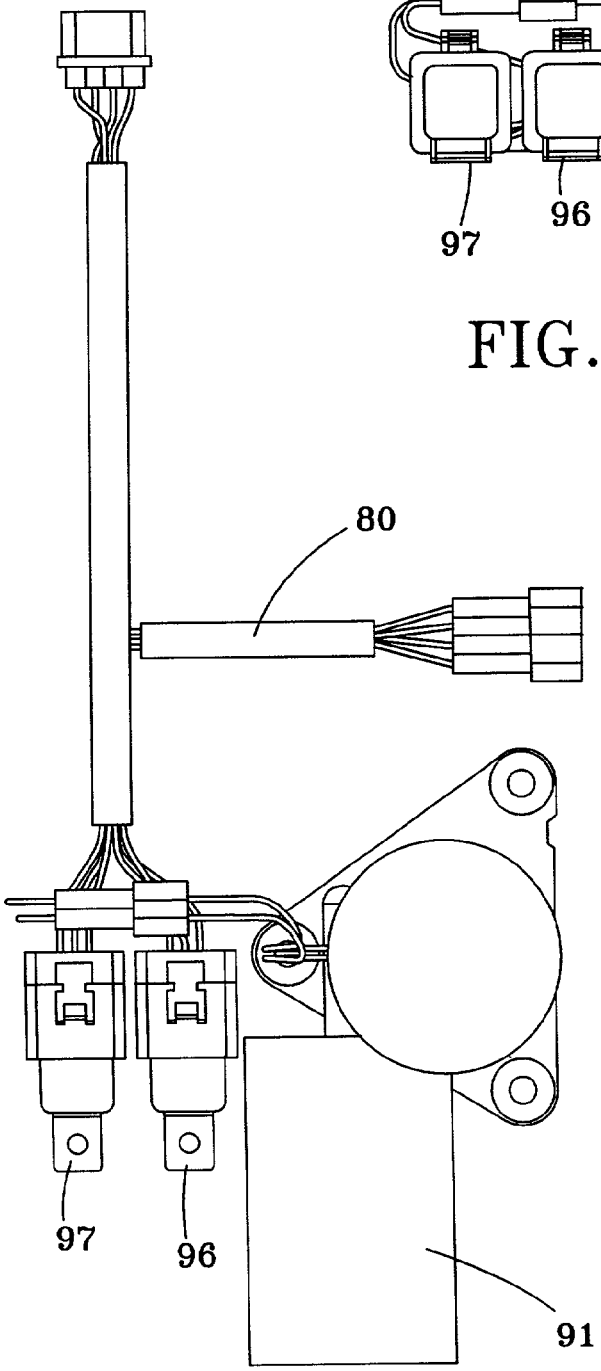
Figure 9C:
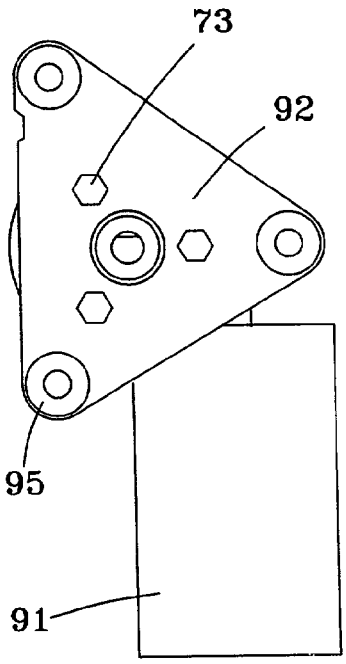

Referring now to FIGS. 9A through 9C, these Figures illustrate a motor that can be used for rotating the drive screw illustrated in FIGS. 6–8. FIGS. 9A through 9C illustrate electrical drive mechanism 90 that comprises motor 91 that is supported by mounting bracket 92. Bracket 92 is fastened by fastener or bolt 93 to any suitable location that permits motor 91 to engage coupler 74 of drive screw 72. Bracket 92 can be affixed to stationary plate 61, or a vehicle floor firewall or other suitable location upon the vehicle. Shaft 94 of motor 91 is dimensioned to engage coupler 74. Rotation of shaft 94 causes coupler 74 and drive screw 72 to rotate and displace sliding plate 65. Grommets 95 provide a flexible interconnection between the motor 91 and bracket 92 as well as absorb vibrations caused by operation of motor 91. Grommets 95 can also compensate for variance of adjacent components. Motor 91 operates in response to a signal received from wiring harness 80, relays 96 and 97, and electrical control system (described in greater detail in connection with FIG. 10).

Figure 10:
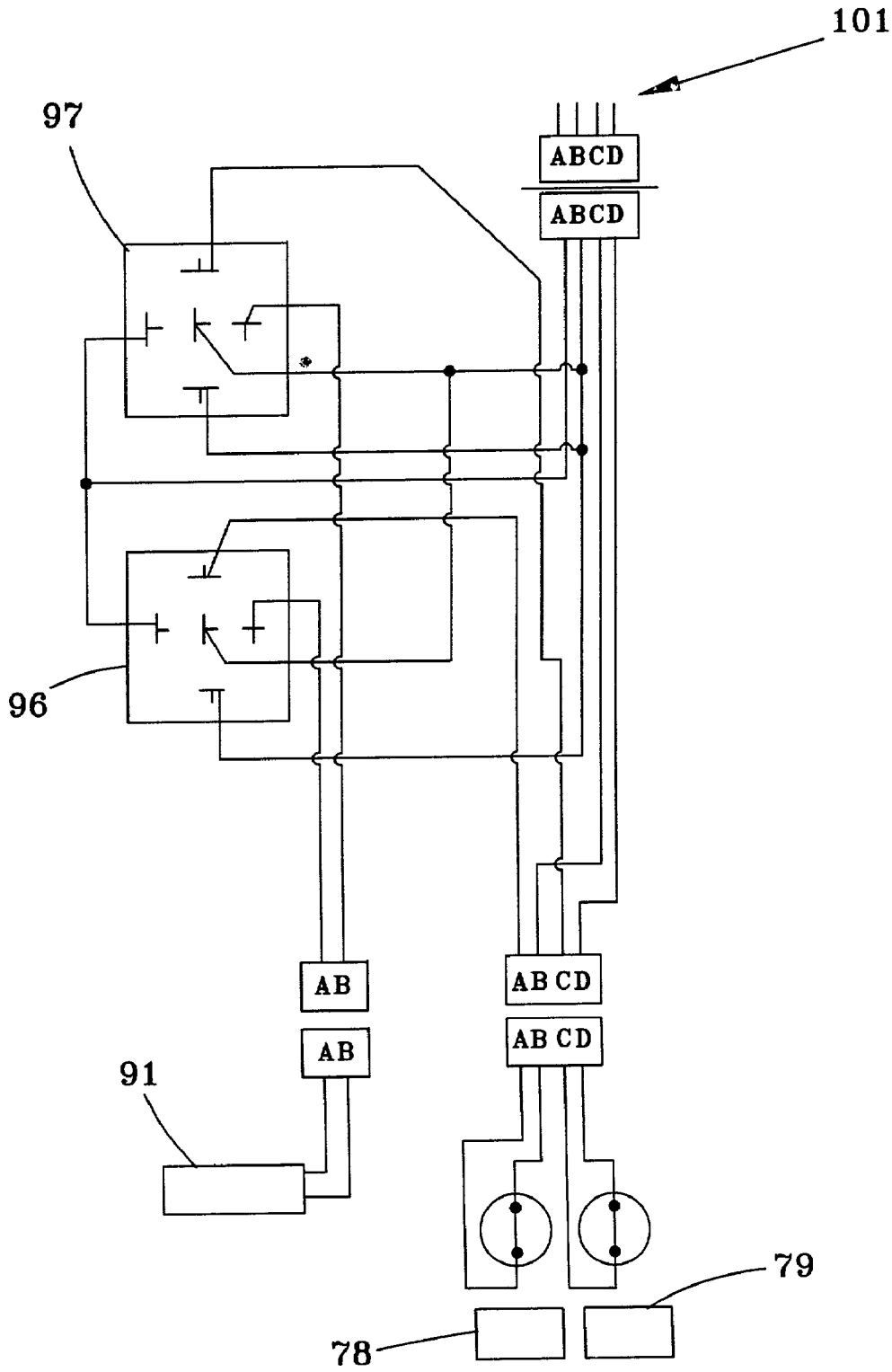
FIG. 10 illustrates a schematic drawing an of an electronic control system that can be used to operate the inventive assembly of FIG. 6.

Referring now to FIG. 10, FIG. 10 illustrates electrical control system 100 and the electrical interconnections among motor 91, limit switches 78 and 79, relays 96 and 97. Electrical control system 100 comprises a four wire system having one wire for supplying power to motor 91, one for ground, one for limit switch 78 and one for limit switch 79. Relays 96 and 97 control direction of the motor by reversing polarity of the motor 91. Limit switches 78 and 79 determine whether power is provided to the relays 96 and 97 by allowing or interrupting current flow to the relays. The exact position of the pedal system between limit switches 78 and 79 is determined by input from the vehicle operator by an operator interface 101.

While the above description places particular emphasis upon an adjustable pedal assembly, the inventive system can be employed for a wide range of applications wherein it is desirable to adjust the position of foot operated pedals, location of a displaceable members relative to another, among other applications.

What is claimed is:

1. A pedal assembly for a vehicle comprising a first plate, a second plate that is located above and movable relative to the first plate wherein the second plate receives at least one pedal wherein one of said at least one pedal comprises a foot operated brake pedal, and a movement mechanism for adjusting the position of the second plate relative to the first plate wherein the movement mechanism comprises an electronic control mechanism comprising at least two limit switches and wherein the second plate defines at least one slot for receiving said at least two limit switches.

2. The pedal assembly of claim 1 wherein the first plate is mounted horizontally relative to a floor of the vehicle, and the second plate is movable in forward and backward directions relative to the first plate wherein the foot operated pedals comprise a brake pedal and a throttle control pedal.

3. The adjustable pedal assembly of claim 1 further comprising a drive screw for moving the second plate.

4. The pedal assembly of claim 2 wherein the foot operated throttle control comprises an electronic throttle control foot pedal.

5. The pedal assembly of claim 2 wherein a spacer plate is located between the first and second plates.

6. The pedal assembly of claim 3 wherein said drive screw comprises a drive screw operated by an electric motor.

7. The pedal assembly of claim 2 wherein the first and second plates define at least partially overlapping openings in order to provide interconnection to the braking and throttle of the vehicle.

8. The adjustable pedal assembly of claim 3 wherein the drive screw is adjacent to a means for operating the drive screw.

9. The adjustable pedal assembly of claim 3 further comprises a shield at least partially covering the drive screw.

10. The adjustable pedal assembly of claim 9 wherein said shield is displaced with said sliding plate.

11. The adjustable pedal assembly of claim 9 wherein said shield is stationary relative to the sliding plate.

12. The adjustable pedal assembly of claim 1 wherein the movement mechanism comprises an electric motor and said electronic control means cause polarity within said motor to vary.

13. The adjustable pedal assembly of claim 1 further comprising at least one pin located on the second plate that engages at least one slot defined on the first plate.

14. An adjustable pedal assembly comprising a stationary plate, a sliding mounting plate located above the stationary plate that is movable relative to the stationary plate wherein the sliding mounting plate receives at least one pedal and wherein the sliding mounting plate defines at least one opening for receiving at least one switch that is located on the stationary plate, and a drive mechanism for displacing the sliding mounting plate relative to the stationary mounting plate wherein the stationary plate defines at least one slot for receiving at least one pin located on the sliding mounting plate.

15. The adjustable pedal assembly of claim 14 wherein the drive mechanism is located above the sliding mounting plate.

16. The adjustable pedal assembly of claim 14 wherein the drive mechanism causes linear displacement of sliding mounting plate.

17. The adjustable pedal assembly of claim 14 wherein the at least one pedal comprises a brake pedal and a throttle pedal.

18. A pedal assembly comprising a stationary plate, a sliding mounting plate located above the stationary plate that is movable in a linear fashion relative to the stationary plate wherein at least one pedal is displaced with the sliding mounting plate and wherein the sliding mounting plate defines at least one opening for receiving at least one switch, and a drive mechanism, which is located above the stationary plate and connected to the stationary plate and the sliding mounting plate, for displacing the sliding mounting plate relative to the stationary mounting plate; and wherein the stationary plate defines at least one slot for receiving at least interference means located on the sliding mounting plate.

* * * * *